US007761933B2

(12) United States Patent
Pham

(10) Patent No.: US 7,761,933 B2
(45) Date of Patent: Jul. 27, 2010

(54) BABY HAT AND METHOD OF MANUFACTURING SAME

(76) Inventor: Anne Pham, 1455 Highwood Dr., McLean, VA (US) 22101

( * ) Notice: Subject to any disclaimer, the term of this patent is extended or adjusted under 35 U.S.C. 154(b) by 711 days.

(21) Appl. No.: 11/748,352

(22) Filed: May 14, 2007

(65) Prior Publication Data

US 2008/0184457 A1 Aug. 7, 2008

Related U.S. Application Data

(63) Continuation-in-part of application No. 11/700,512, filed on Feb. 1, 2007, now abandoned.

(51) Int. Cl.
*A42B 1/06* (2006.01)

(52) U.S. Cl. ..... 2/410

(58) Field of Classification Search ..... 2/410, 2/411; 5/636; 297/393
See application file for complete search history.

(56) References Cited

U.S. PATENT DOCUMENTS

| | | | | |
|---|---|---|---|---|
| 1,491,146 | A | 4/1924 | Larson | |
| 1,713,049 | A | 3/1928 | Millson | |
| 3,780,379 | A | 12/1973 | Kampman | |
| 4,581,773 | A | 4/1986 | Cunnane | |
| 4,646,367 | A | 3/1987 | El Hassen | |
| 4,951,337 | A | 8/1990 | Hull et al. | |
| 5,075,903 | A | 12/1991 | Richoux | |
| 5,615,419 | A | 4/1997 | Williams | |
| 5,768,715 | A | 6/1998 | Gregg, III et al. | |
| 6,238,413 | B1 | 5/2001 | Wexler | |
| 6,381,760 | B1 | 5/2002 | Lampe et al. | |
| 6,397,399 | B1 | 6/2002 | Lampe et al. | |
| 6,493,881 | B1 | 12/2002 | Picotte | |
| 7,153,284 | B2 | 12/2006 | Argenta | |
| 7,430,765 | B2 * | 10/2008 | Brown et al. | 2/202 |
| 7,563,237 | B1 * | 7/2009 | Murphy | 602/17 |
| 7,566,313 | B1 * | 7/2009 | Argenta | 602/17 |
| 2005/0278832 | A1 * | 12/2005 | Harrington | 2/411 |
| 2008/0184489 | A1 * | 8/2008 | Pham | 5/636 |

* cited by examiner

*Primary Examiner*—Katherine Moran
(74) *Attorney, Agent, or Firm*—Garcia-Zamor IP Law; Ruy M. Garcia-Zamor

(57) ABSTRACT

Hats preferably for supporting and protecting a portion of a baby's head and methods of making same.

28 Claims, 6 Drawing Sheets

BABY HAT AND METHOD OF MANUFACTURING SAME

CROSS-REFERENCE TO RELATED APPLICATION

This application is a continuation-in-part of and claims priority to U.S. patent application Ser. No. 11/700,512, filed Feb. 1, 2007, now abandoned invented by Anne Pham, which is hereby incorporated by reference herein as if set forth in its entirety.

BACKGROUND

The present invention relates generally to hats and, more particularly, to hats that are preferably used for babies to provide support and protection and, in some situations, stability thereto.

According to medical studies conducted between 1981 and 1991, there is a strong correlation between infants sleeping in a prone position (i.e., on their stomachs) and death from sudden infant death syndrome ("SIDS") or crib death. Infants generally are most vulnerable to risks of SIDS between the age of 2 and 4 months. Infants who died from SIDS were generally found suffocated—i.e., dead from on their stomach with their faces, noses, and mouths covered by soft bedding, such as pillows, quilts, comforters and sheepskins.

In 1992, the American Academy of Pediatricians ("AAP") issued a number of recommendations as part of a campaign to reduce the risk of SIDS. The AAP policy recommendations, which are commonly known as the AAP "Back to Sleep" Campaign, are as follows: (1) infants should sleep on their backs to reduce the risks of SIDS; (2) infants should sleep on a firm, tight-fitting mattress, and never on a waterbed, soft mattress, pillow or other soft surface; (3) measures should be taken to prevent the infant from overheating while sleeping (i.e., the infants should not be overdressed in excessive clothing); and (4) pillows, quilts, comforters, pillow-like stuffed toys, and other soft products should be removed from the crib in order to eliminate the risk that the infant's face and mouth accidentally might be covered by these items while the infant is asleep.

The AAP "Back to Sleep" campaign has substantially reduced SIDs deaths (by as much as 40 percent according to some studies). However, it also has resulted in certain unintended consequences. Specifically, there has been a dramatic increase (by as much as 500 percent) in the number of babies with "positional" skull deformities, such as positional plagiocephaly or commonly referred to as flat heads. For instance, in 1974, positional plagiocephaly occurred once in every 300 live births among prone-sleeping infants. Following the "Back to Sleep" program, the frequency of positional phagiocephaly increased to 1 in 60. Infant skull deformities generally become severe during the first few weeks of life, as the infant spend a significant number of hours each day sleeping on his or her back, consistent with the AAP's recommendation. Further, incidents of torticollis or twisted neck, a condition where the infant has a tendency to keep his or her head tilted to one side only, also increased significantly.

The increases in positional phagiocephaly and torticollis are attributable to the infants sleeping on a firm surface coupled with the fact that all soft bedding materials are removed from the crib, as recommended by AAP. The consequence is that the infant's head rests on a firm surface, and the weight of the baby's head pressing down against this fat surface results in pressure being applied to the back area of the baby's head, thereby causing that area of the infant's head to flatten. Indeed, the AAP itself has recognized that the increasing incidence of skull deformity, such as the flat head syndrome, is likely attributable its the Back to Sleep campaign.

There are three basic types of treatments for positional plagiocephaly. First, the infant could be repositioned during sleep so as to alternate the sleeping positions. Second, "skull-molding" devices could be used to reshape the infant's skull. Third, in rare instances when the deformities are severe, surgery could be used as the last resort option.

It may be advantageous to provide a hat that: preferably may provide a comfortable head cover for a baby; preferably may include protective padding; and that preferably may help comfortably cushion and position a baby's head when the baby is lying on his or her back or being held.

SUMMARY

Briefly speaking, one embodiment of the present invention is directed to a method of manufacturing a hat adapted to support and protect a head of a baby when the baby is lying on a generally flat surface. The method includes the steps of: providing a lower hat section formed by woven fabric. The lower hat section includes a sleeve positioned to form a fold with one portion of the sleeve overlying another portion of the sleeve such that the sleeve forms inner and outer hat layers. The fold defines a hat bottom adapted for placement over the head of the baby with the inner hat layer substantially covering a brow and a back of the head of the baby. The inner and outer hat layers form a pocket therebetween with a pocket opening located generally opposite the fold and adapted to provide access to the pocket. The method includes providing an upper hat section formed by woven fabric. The upper hat section includes a plurality of bands arranged in a generally checkered pattern to define a plurality of openings through the upper hat section to facilitate venting of heat and/or moisture therethrough. The method includes: locating the upper hat section on the lower hat section; positioning at least one fastener within the pocket to facilitate securing at least on pad thereto; providing the least one pad adapted to be inserted in the pocket to cushion a portion of the head of the baby and to facilitate the prevention of deformation of the head of the baby caused by the baby lying on the generally flat surface; and inserting the at least one pad in the pocket to provide the hat for the baby with an inner surface of the inner hat layer providing a generally smooth, flexible woven fabric surface that is free of any fasteners, straps, and buckles which may abrade the head of the baby and with the pad protecting at least a portion of the head of the baby. The hat forms a generally deformable head support adapted to align the head of the baby while the baby is lying on the generally flat surface to facilitate the prevention of deformation of the head of the baby caused by the flat surface.

In a separate aspect, the present invention is directed to a method of manufacturing a hat adapted to support and protect a head of a baby when the baby is lying on a generally flat surface. The method includes providing a lower hat section formed by woven fabric. The lower hat section includes a sleeve configured for placement over the head of the baby to substantially cover a brow and a back of the head of the baby. The method includes providing an upper hat section formed by woven fabric. The upper hat section includes a plurality of bands arranged in a generally checkered pattern to define a plurality of openings through the upper hat section to facilitate venting of heat and/or moisture therethrough. The plurality of openings occupy at least twenty (20%) percent of the area covered by the upper hat section. The method includes:

locating the upper hat section on the lower hat section; positioning at least one fastener an outer surface of the lower hat section to allow the attachment of at least one pad thereto; providing at least one pad adapted to cushion a portion of the head of the baby and to facilitate the prevention of deformation of the head of the baby caused by the baby lying on a flat surface; and securing the at least one pad onto the outside of the lower hat section wherein an inner surface of the lower hat section generally provides a smooth, flexible woven fabric surface adapted to contact the head of the baby and with the at least one pad protecting at least a portion of the head of the baby. The hat forms a generally deformable head support adapted to properly align the head of the baby while the baby is lying on the generally flat surface to facilitate prevention of deformation of the head of the baby caused by the generally flat surface.

In a separate aspect, the present invention is directed to a method of manufacturing a hat adapted to support and protect a head of a baby when the baby is lying on a generally flat surface. The method includes the steps of providing a lower hat section. The lower hat section includes a sleeve positioned to form a fold with one portion of the sleeve overlying another portion of the sleeve such that the sleeve forms inner and outer hat layers. The fold defines a hat bottom adapted for placement over the head of the baby with the inner hat layer substantially covering a brow and a back of the head of the baby. The inner and outer hat layers form a pocket therebetween with a pocket opening located generally opposite the fold and adapted to provide access to the pocket. The method includes providing an upper hat section. The upper hat section includes a plurality of bands arranged in a generally checkered pattern to define a plurality of openings through the upper hat section to facilitate venting of heat and/or moisture therethrough. The plurality of openings occupy at least twenty (20%) percent of the area covered by the upper hat section. The method includes: locating the upper hat section on the lower hat section; positioning at least one fastener within the pocket to secure at least one pad thereto; providing the at least one pad adapted to be inserted in the pocket to cushion a portion of the head of the baby and to facilitate the prevention of deformation of the head of the baby caused by the baby lying on a flat surface; and inserting the at least one pad in the pocket to provide the hat for the baby with an inner surface of the inner hat layer providing a generally smooth surface adapted to contact the head of the baby and with the at least one pad protecting at least a portion of the head of the baby. The hat forms a generally deformable head support adapted to properly align the head of the baby while the baby is lying on the generally flat surface to facilitate prevention of deformation of the head of the baby caused by the generally flat surface.

In a separate aspect, the present invention is directed to a method of manufacturing a hat adapted to protect and support a head of a baby lying on a generally flat surface. The method includes the steps of providing a lower hat section. The lower hat section includes a sleeve positioned to form a fold with one portion of the sleeve overlying another portion of the sleeve such that the sleeve forms inner and outer hat layers. The fold defines a hat bottom adapted for placement over the head of the baby with the inner hat layer substantially covering a brow and a back of the head of the baby. The inner and outer hat layers forming a pocket therebetween with a pocket opening located generally opposite the fold and adapted to provide access to the pocket. The method includes: securing a portion of the inner and outer hat layers together in a location proximate to an area configured to cover the brow of the baby to prevent the outer hat layer from shifting downwardly and covering portions of a face of the baby not intended to be covered by the hat when the hat is placed thereon; locating an upper hat section on the lower hat section; positioning at least one fastener within the pocket adapted to secure at least one pad thereto; providing at least one pad adapted to be inserted in the pocket to cushion a portion of the head of the baby and to facilitate the prevention of deformation of the head of the baby caused by the baby lying on a flat surface; and inserting the at least one pad in the pocket to provide the hat for the baby with an inner surface of the inner hat layer providing a smooth surface that is free of any fasteners, straps, and buckles which may abrade the head of the baby and with the pad protecting at least a portion of the head of the baby. The hat forms a generally deformable head support adapted to properly align the head of the baby while the baby is lying on the generally flat surface to facilitate prevention of deformation of the head of the baby caused by the generally flat surface.

In a separate aspect, the present invention is directed to a method of manufacturing a hat that protects a head of a baby. The method includes the steps of: providing a lower hat section formed by woven fabric. The lower hat section includes a sleeve positioned to form a fold with one portion of the sleeve overlying another portion of the sleeve such that the sleeve forms inner and outer hat layers. The fold defines a hat bottom adapted for placement over the head of the baby with the inner hat layer substantially covering a brow and a back of the head of the baby. The inner and outer hat layers form a pocket therebetween with a pocket opening located generally opposite the fold and adapted to provide access to the pocket. The method includes providing an upper hat section formed by woven fabric. The upper hat section includes a plurality of bands arranged in a generally checkered pattern to define a plurality of openings through the upper hat section to facilitate venting of heat and/or moisture therethrough. The method includes: locating the upper hat section on the lower hat section; providing at least one pad adapted to be inserted in the pocket to cushion a portion of the head of the baby and to facilitate the prevention of deformation of the head of the baby caused by the baby lying on a generally flat surface; and inserting the at least one pad in the pocket to protect at least a portion of the head of the baby. The hat forms a generally deformable head support adapted to properly align the head of the baby while the baby is lying on the generally flat surface to facilitate prevention of deformation of the head of the baby caused by the generally flat surface.

In a separate aspect, the present invention is directed to a hat adapted to support and protect a head of a baby when the baby is lying on a generally flat surface including a lower hat section formed by woven fabric. The lower hat section includes a sleeve positioned to form a fold with one portion of the sleeve overlying another portion of the sleeve such that the sleeve forms inner and outer hat layers. The fold defines a hat bottom adapted for placement over the head of the baby with the inner hat layer substantially covering a brow and a back of the head of the baby. The inner and outer hat layers forming a pocket therebetween with a pocket opening located generally opposite the fold and adapted to provide access to the pocket. An upper hat section is formed by woven fabric. The upper hat section includes a plurality of bands arranged in a generally checkered pattern to define a plurality of openings through the upper hat section to facilitate venting of heat and/or moisture therethrough. The upper hat section is located on the lower hat section. At least one fastener is located within the pocket to facilitate securing at least on pad thereto. The least one pad adapted to be inserted in the pocket to cushion a portion of the head of the baby and to facilitate the prevention of deformation of the head of the baby caused by the baby lying on the generally flat surface. The at least one pad is adapted for insertion in the pocket to provide the hat for the baby with an inner surface of the inner hat layer providing a generally smooth, flexible woven fabric surface that is free of any fasteners, straps, and buckles which may abrade the head of the baby and with the pad adapted to protect at least a portion of the head of the baby. The hat forms a generally deformable head support adapted to align the head of the baby while the baby is lying on the generally flat surface to facilitate the prevention of deformation of the head of the baby caused by the flat surface.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings.

DETAILED DESCRIPTION OF THE PREFERRED EMBODIMENTS

Figure 1:
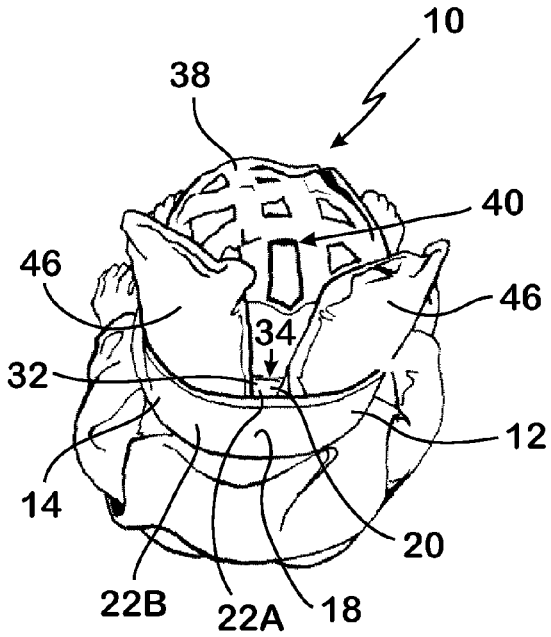
FIG. 1 is a perspective view of a hat according to a preferred embodiment of the present invention; The hat is positioned on the head of a baby with an upper hat section formed by bands that are configured in a checkered pattern; A lower hat section is formed by a sleeve positioned to form a fold and defining a pocket; Two pads are positioned in the pocket to cushion the baby's head and/or prevent the baby's head from rotating when the baby is lying on its back.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the hat and designated parts thereof. The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-13, wherein like numerals indicate like elements throughout, a preferred embodiment of a hat according to the present invention is shown and generally designated as 10. Briefly speaking the hat 10 is preferably a comfortable hat that provides padding to cushion and/or position a baby's head. The hat may be used to position the baby's head to encourage the baby to lie in a supine position to reduce risks of sudden infant death syndrome (SIDS) while at the same time providing gentle support to the back of the baby's head to reduce the risks of skull deformities. The hat 10 may also be used in other applications and/or activities where the back of the infant's head requires support. For example, the hat 10 can serve as a tool for breastfeeding mothers to facilitate optimal mouth to nipple alignment for proper latching.

The hat 10 can be used in a number of other activities where the baby's head needs to be controlled and supported, such as when the baby's diaper is being changed and a soft surface is not available. With respect to breastfeeding, the hat 10 may facilitate proper latching of the baby's mouth to the mother's nipple for optimal breastfeeding.

The hat 10 is preferably formed of a flexible, durable material such as woven cotton. However, those of ordinary skill in the art will appreciate from this disclosure that any suitable material, woven or not, can be used to form the hat 10 of the present invention. For example, the hat can be formed by synthetic fabric, linen, nylon, fleece, polyester, or a blended material, or the like without departing from the scope of the present invention.

Figure 13:
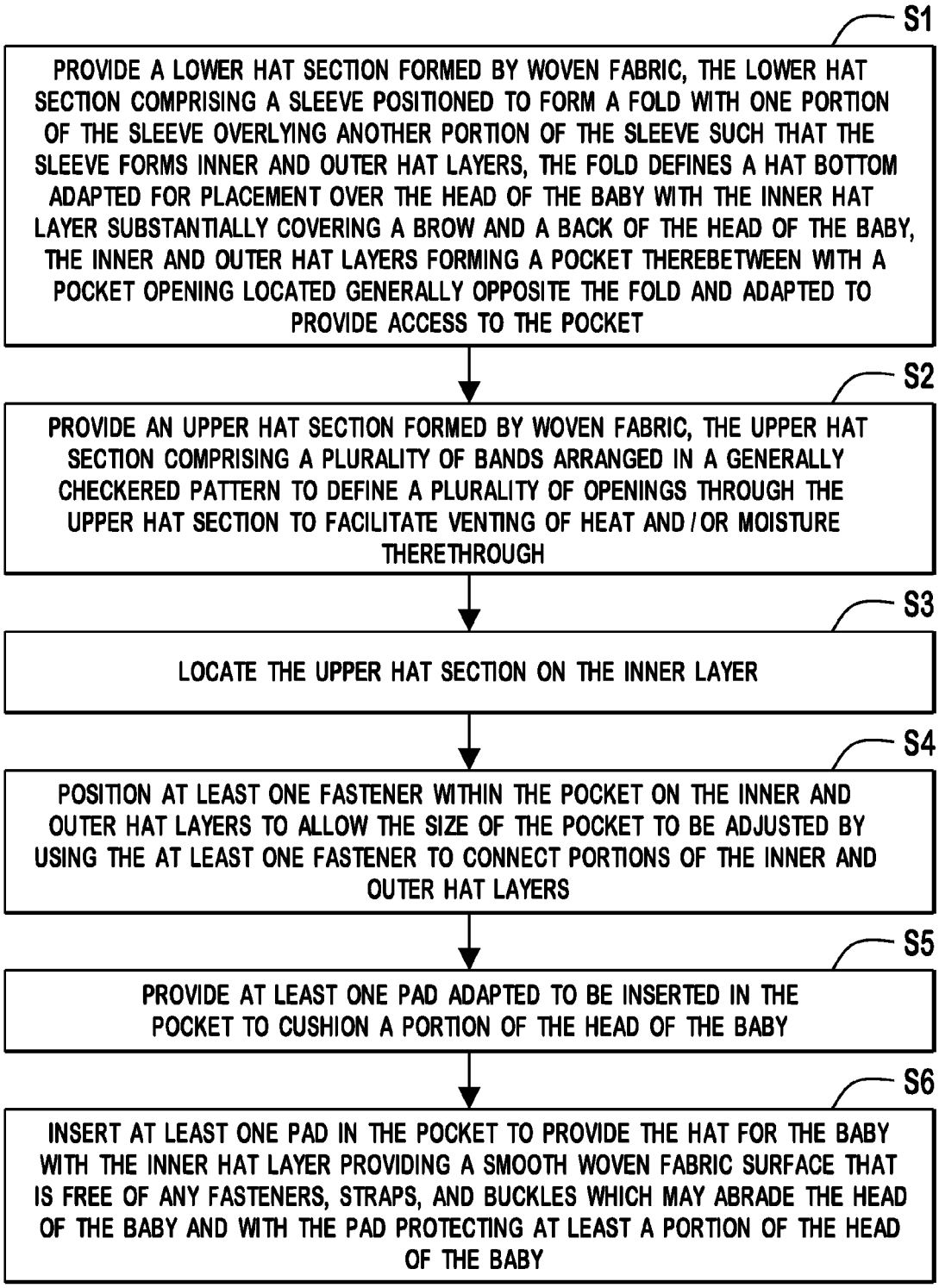
FIG. 13 is a flowchart showing one preferred method of manufacturing a hat according to the present invention.

Referring to FIGS. 1 and 13, one method of manufacturing the hat according to a preferred embodiment of the present invention is as follows. The steps of the present invention can be performed in any order without departing from the scope of the present invention.

Figure 7:
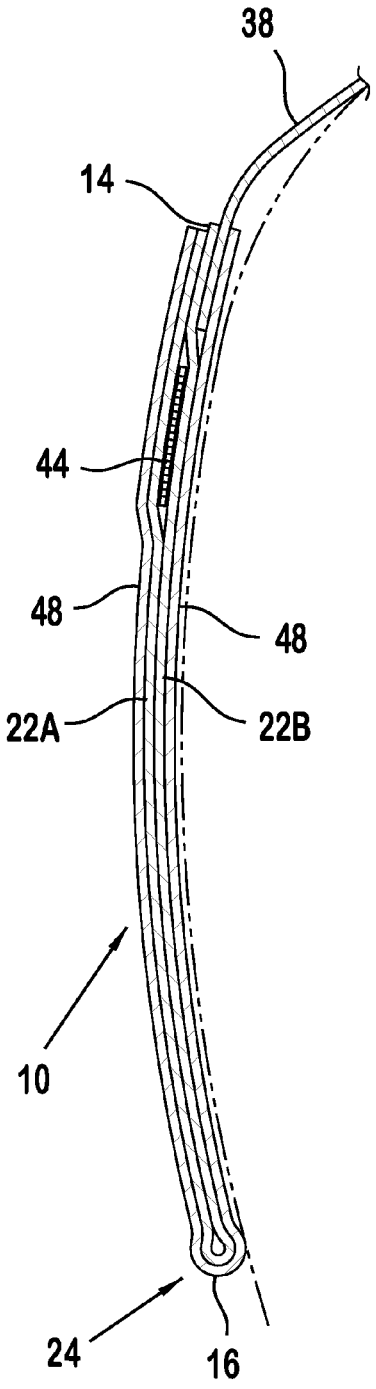
FIG. 7 is a vertical cross sectional view taken along one side of a hat of the present invention similar to that shown in FIG. 1; The sleeve is positioned through a fold to form inner and outer hat layers; Another material having a different appearance is located on a one surface of the sleeve such that when the sleeve is positioned to form the fold, the hat appears to have a different material on the outer hat layer from that on the inner hat layer.
Figure 8:
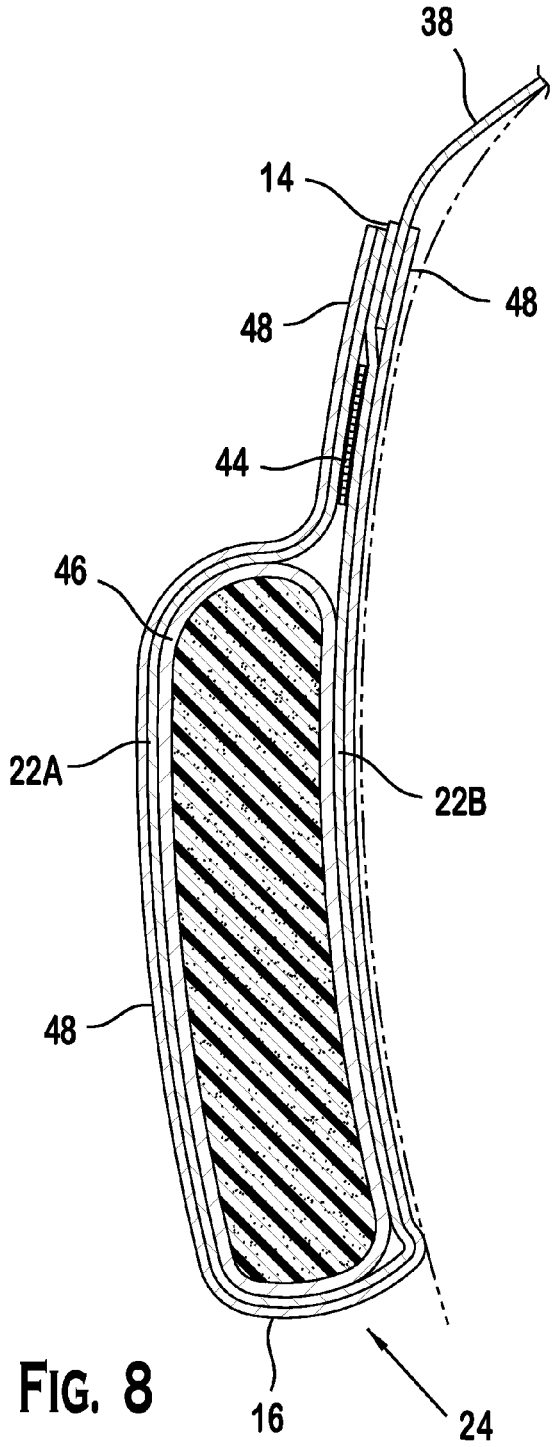
FIG. 8 is a vertical cross section view of the hat of the present invention similar to that shown in FIG. 7 illustrating a pad located within the pocket and secured therein by a fastener.
Figure 9:
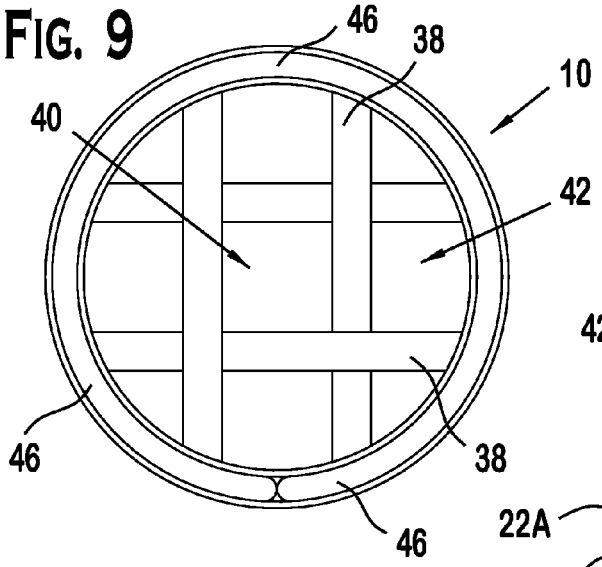
FIG. 9 is a top plan view showing the hat of FIG. 1 with a pad configured to encircle the entire head of a baby.

In step S1, the first preferred method includes providing a lower hat section 12 preferably, but not necessarily, formed by woven fabric. The lower hat section may include a sleeve 14 positioned to form a fold 16 with one portion 18 of the sleeve 14 overlying another portion 20 of the sleeve 14 such that the sleeve 14 forms inner and outer hat layers 22A, 22B. FIGS. 7 and 8 illustrate the fold 16.

The fold 16 defines a hat bottom 24 adapted for placement over the head of the baby 28 with the inner hat layer 22A substantially covering a brow 26 and a back 30 of the head of the baby 28. The inner and outer hat layers 22A, 22B preferably form a pocket 32 therebetween with a pocket opening 34 located generally opposite the fold 16 and adapted to provide access to the pocket 32.

Referring still to FIGS. 7 and 8, another preferably, but not necessarily, woven fabric 48, having a different appearance from the sleeve 14, may be positioned on one surface of the sleeve 14 such that when the sleeve 14 is positioned to form the fold 16, the hat 10 appears to have a different material on the outer hat layer 22B from that on the inner hat layer 22A when the hat 10 is positioned on the head of the baby 28. It is also preferred, but not necessary, that inner and outer hat layers 22A, 22B are secured together in a location proximate an area configured to cover the brow 26 of the baby 28 to prevent the outer hat layer 22B from covering portions of the face of the baby 28 not intended to be covered by the hat 10 when the hat 10 is placed thereon.

Referring to FIGS. 1, 2, 5, 9, and 13, during step S2, an upper hat section 36 is provided that is preferably formed by woven fabric. The upper hat section 36 may include a plurality of bands 38 arranged in a generally checkered pattern 40 to define a plurality of openings 42 through the upper hat section to facilitate venting of heat and/or moisture therethrough. It is preferred that the bands 38 include two generally horizontal, spaced apart bands 38 and two generally vertical, spaced apart bands 38. This results in a central generally square opening 42 with partially rectilinear openings 42 adjacent to it. However, those of ordinary skill in the art will appreciate from this disclosure that any number of bands 38 can be used without departing from the scope of the present invention. Furthermore, the upper hat section 36 can be formed without openings 42 without departing from the present invention. That is the upper hat section 36 can be formed of a layer of material or can be formed by gathering a portion of the sleeve together without departing from the scope of the present invention.

As best shown in FIGS. 9-12, it is preferred, but not necessary, that the openings 42 occupy between twenty and sixty percent of the area covered by the upper hat section 36. Alternatively, it is preferred that the openings 42 occupy at least thirty percent of the area covered by the upper hat section 36. More preferably, the openings 42 occupy at least forty percent of the area covered by the upper hat section 36. Those of ordinary skill in the art realize that the area occupied by the openings 42 can be varied or the openings 42 eliminated altogether without departing from the scope of the present invention.

Referring to FIGS. 3-5 and 13, the upper hat section 36 is located on the lower hat section during step S3. The upper and lower hat sections 36, 12 can be formed as two pieces that are later connected or manufactured at the same time as a single piece without departing from the scope the present invention.

Referring to FIGS. 7, 8, 11, and 13, in step S4, at least one fastener 44 is preferably located within the pocket 32 on the inner and outer hat layers 22A, 22B to allow the size of the pocket 32 to be adjusted by using the at least one fastener 44 to connect portions of the inner and outer hat layers 22A, 22B. The fasteners 44 are preferably formed of hook and loop material, but can be buttons, snaps, ties, zippers, or any other suitable connector without departing from the scope of the present invention. For example, as shown in FIGS. 6-8 and 11, multiple patches of hook and loop material can be positioned on the inner and outer hat layers 22A, 22B to allow the configuration of the pocket to be varied depending on the size or shape of the pad 46 inserted therein.

Figure 11:
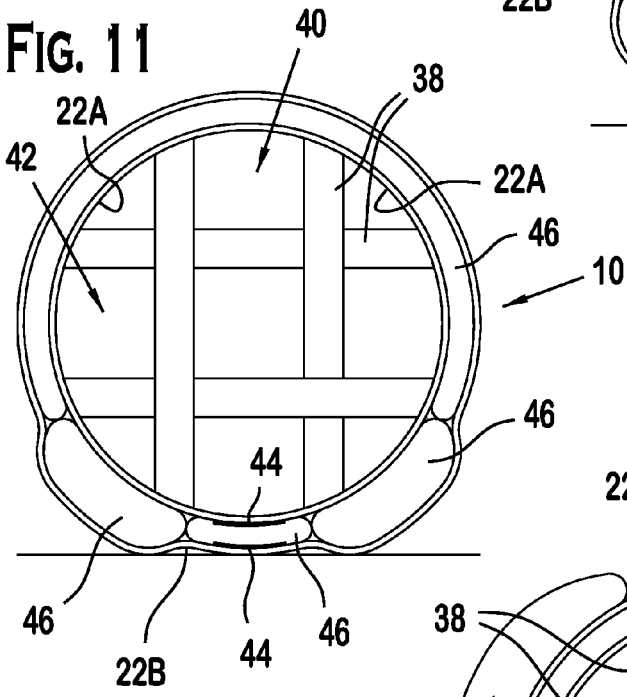
FIG. 11 is a top plan view of the hat of FIG. 1 showing multiple pads that protect all of the baby's head while also preventing lateral rolling thereof while the baby is lying on its back.

As shown in FIG. 11, a pad 46 may also have fasteners on opposing surfaces to allow one surface of the pad 46 to be secured to the inner hat layer 22A and the opposing pad surface to be fastened to the outer hat layer 22B. Thus, pads can be inserted and held in place by friction, can be held in place by closing the pocket thereover or therearound, and/or can be fastened in position.

Referring again to FIGS. 1, 8, and 13, at least one pad 46 is provided during step S5. The pad 46 is adapted to be inserted in the pocket 32 to cushion a portion of the head of the baby 28. In step S6, the pad 46 is inserted in the pocket 32 to provide a hat 10 for the baby 28 with an inner surface of the inner hat layer 22A preferably providing a smooth woven fabric surface that is free of any fasteners, straps, and buckles which may abrade the head of the baby 28 and with the pad 46 protecting at least a portion of the head of the baby 28.

Figure 2:
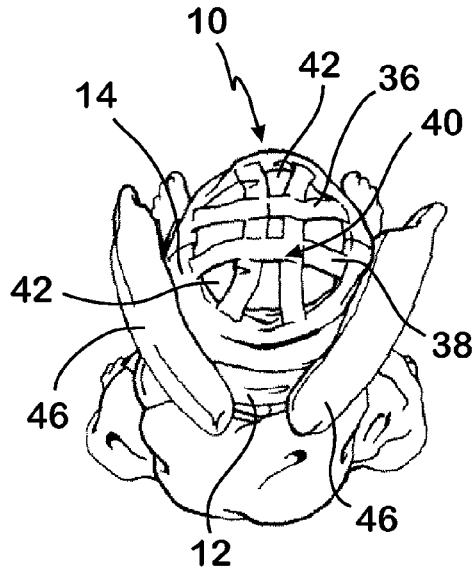
FIG. 2 is perspective view of a second preferred embodiment of the hat of the present invention; At least another pad is fastened to the outer surface of the lower hat section.
Figure 3:
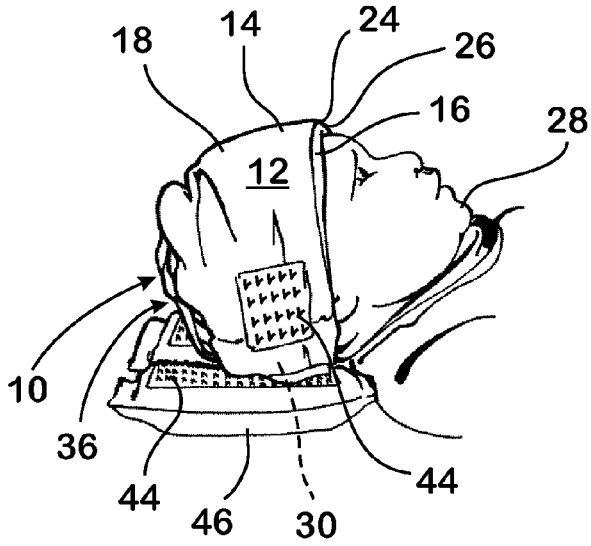
FIG. 3 is a side elevational view of the hat of FIG. 2 illustrating hook and loop material being used to fasten the at least another pads to the lower hat section; In this configuration the at least another pads prevent the baby's head from rolling while the baby is in lying on its back while also providing cushioning for the baby's head.
Figure 12:
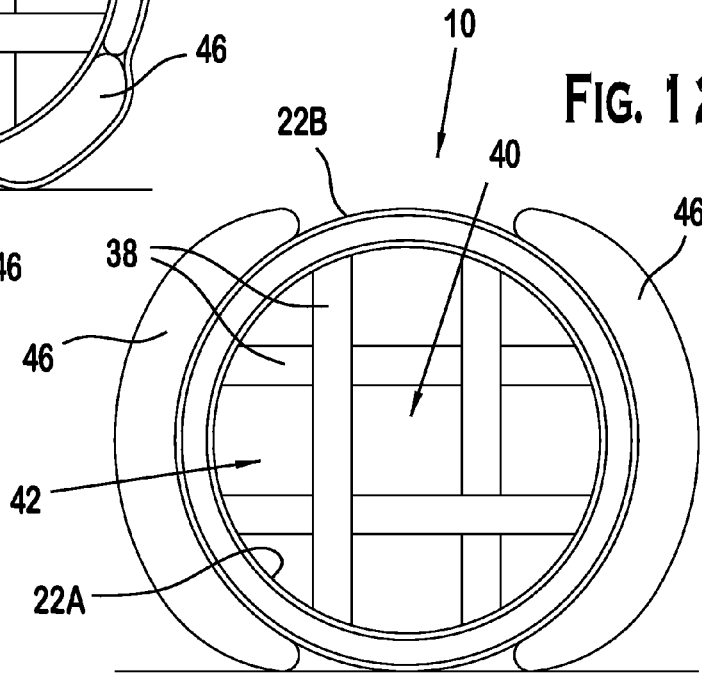
FIG. 12 is a top plan view of the hat of FIG. 4 showing two pads for cushioning the baby's head while preventing lateral rolling thereof while the baby is positioned on its back.

Referring to FIGS. 2, 3 and 12, at least another fastener 44 may be positioned on the outer surface of the lower hat section 12 to allow the attachment of at least another pad 46 to the outside thereof. The pads 46 may be of any shape (as demonstrated by FIGS. 9-12) and may be filled, with foam, gel, beads, liquid, polymer, rubber, elastomer, or any other suitable material without departing from the scope of the present invention. The method may include fastening the at least another pad 46 to the outside of the lower hat section 12 so that the hat 10 provides cushioning due to the at least another pad 46 fastened to the lower hat section.

Figure 4:
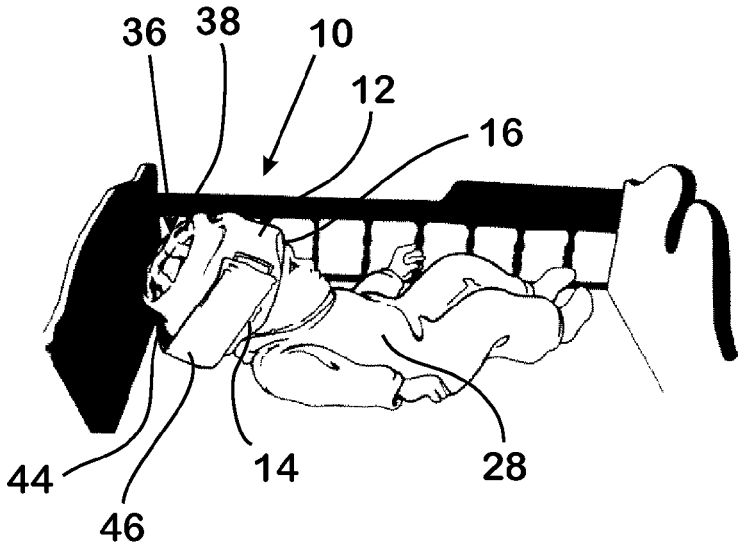
FIG. 4 is a side elevational view similar to that of FIG. 4 showing the baby in a crib with the at least another pads being configured in a different orientation; The hat can stabilize a baby's head while the baby lays in its crib which is especially beneficial if the baby's neck muscles are still developing.
Figure 5:
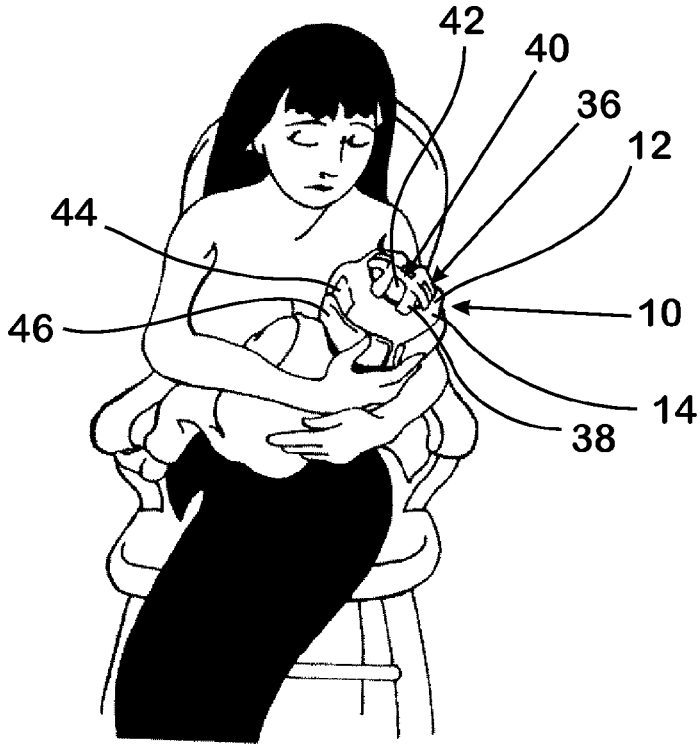
FIG. 5 is a perspective view of a baby with the hat of FIG. 3 being nursed; The hat makes it easier to hold the baby's head in position during the nursing process.

Referring to FIGS. 1, 3, 4, 5, and 10, the pads 46 can be placed in various positions on the hat 10 so as to allow a mother to position/control the baby's head to achieve optimal mouth to nipple contact (as shown in FIG. 5). For example, while the baby 28 is being fed (via breastfeeding or bottle feeding), the baby 28 may shift or wiggle her body and rub her head against the mother's arm or that of the caregiver, thereby causing stress on the baby's head. The head of a baby is the heaviest part of her body, making it difficult for the baby 28 to hold up his/her head or keep it in balance—i.e., a baby's head tends to wobble back and forth.

Further, certain breastfeeding positions, such as the clutch or "football" hold requires the mother to hold/grip the baby's head directly in her hand, sometimes using the lower part of the palm and several of the fingers. This may cause pressure and stress on a newborn's soft and developing head. As a result, new mothers are often concerned that they may hurt their baby's head if they hold the baby's head too firmly, which is sometimes necessary to keep the baby's mouth and head on target for the purpose of maintaining proper latch. The hat 10 may directly aid this process by allowing a better grip for the mother to position the baby's head as well as maintaining the grip for the duration of the breastfeeding session.

The hat 10 may also helps support the baby's neck, and allow the baby to stay in the various breastfeeding positions comfortably. Further, mothers often must nurse their babies outside of the home environment. As such, it is not practical for them to carry with them various nursing support aids with them, such as wedges, pillows, etc. As this hat 10 and its attachments are small, compact, and aesthetically appealing, it can be highly portable and can assist the mother with breastfeeding sessions "on the go" in public places, and therefore may support breastfeeding both inside and outside the home environment.

Figure 10:
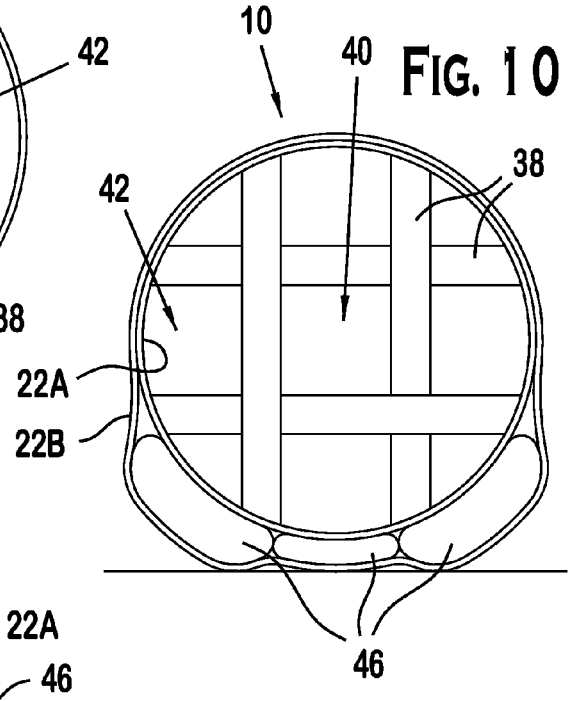
FIG. 10 is a top plan view of the hat of FIG. 1 showing three pads inserted in the pocket to cushion the back of a baby's head while preventing lateral rolling while the baby is lying on its back.

Additionally, the hat 10 may be worn as support to the baby's head while changing the baby's diaper and a soft surface is not available. For example, in an environment outside of the home, mothers often have to change their baby's diapers using any flat surface, such as a table or a public bench, or plastic changing tables found in most public restrooms. In these situations, the baby's head may have to rest on a firm, hard surface, such as a table. As shown in FIGS. 3, 10, and 11, wearing the hat 10 may alleviate pressure and stress against the back 30 of the baby's head.

The hat 10 may also help to reduce reflux by elevating the baby's head. It also provides support in bottle-feeding, burping, and bathing the baby by serving as a "head gripper" in these instances. In addition to the positioning, the hat 10 may also serve to protect the fragile cervical/neck muscles located in the back of the head.

Additional preferred embodiments of a method of manufacturing a hat for a baby according to the present invention are described below. Those of ordinary skill in the art will appreciate from this disclosure that generally similar steps and generally similar structural components of the hat 10 described below should: generally have similar structure, general include similar alternate constructions, and generally operate in a similar manner as that described above, unless stated otherwise. The steps of any of the methods of the present invention can be performed in any order, interchanged with steps recited in other preferred methods, or omitted, without departing from the scope of the present invention.

Figure 6:
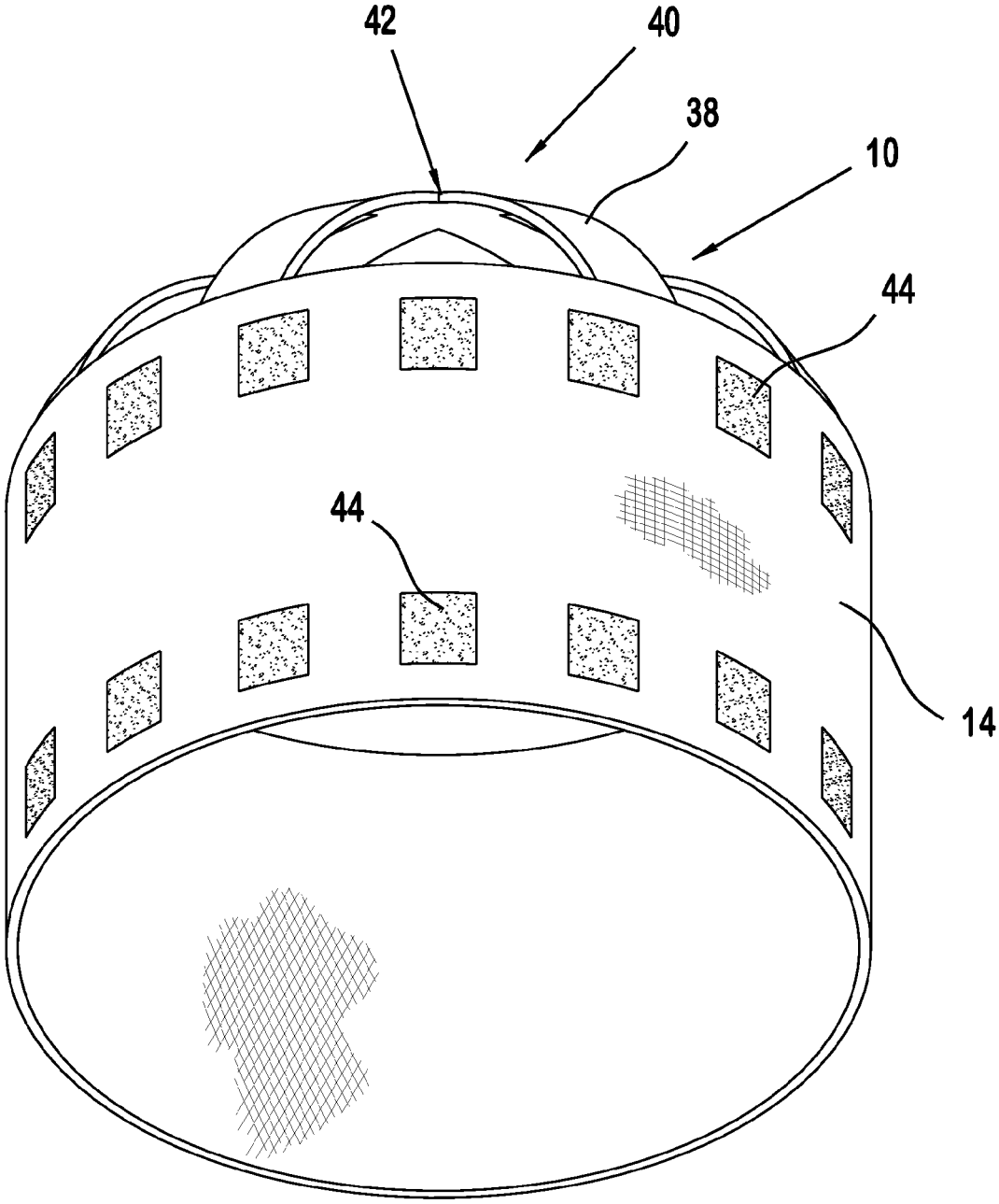
FIG. 6 is a perspective view of the sleeve of the hat of FIG. 1 prior to the sleeve being positioned to form a fold; Fasteners are positioned on the sleeve so that once the fold is formed and the associated pocket, fasteners will be positioned in the pocket on the inner and outer hat layers; The smooth inner surface of the inner hat surface is also shown as being free of any fasteners, straps, and buckles that may abrade the head of the baby.

Referring to FIGS. 2 and 6, a second preferred method of manufacturing a hat 10 that protects a head of a baby includes providing a lower hat section 12 that includes a sleeve 14 configured for placement over the head of the baby 28 to substantially cover a brow 26 and a back 30 of the head of the baby 28. This hat 10 preferably uses a single layer of material to form the lower hat section 12. However, multiple layers of material can be used without departing from the scope of the present invention. An upper hat section 36 is provided that may include bands 38 arranged in a generally checkered pattern 40 to define a plurality of openings 42 through the upper hat section 36. Referring to FIGS. 2 and 3, the upper hat section 36 is located on the lower hat section 12. Referring to FIG. 4, at least one fastener 44 is positioned on an outer surface of the lower hat section 12 to allow the attachment of at least one pad 46 thereto.

At least one pad 46 is provided that is adapted to cushion a portion of the head of the baby 28. The at least one pad 46 is secured onto the outside of the lower hat section 12 resulting in the inner surface of the lower hat section 12 providing a smooth surface (as shown in FIG. 6) that is preferably free of any fasteners, straps, and buckles which may abrade the head of the baby and with the at least one pad 46 protecting at least a portion of the head of the baby.

Referring to FIGS. 3, 6, and 7, a third preferred method of manufacturing a hat 10 according to the present invention includes providing a lower hat section 12 including a sleeve 14 positioned to form a fold 16 with one portion 18 of the sleeve overlying another portion 20 of the sleeve 14 such that the sleeve 14 forms inner and outer hat layers 22A, 22B. The fold 16 defines a hat bottom 24 adapted for placement over the head of the baby 28 with the inner hat layer 22A substantially covering a brow 26 and a back 30 of the head of the baby 28. The sleeve can be formed of any suitable material whether woven or not. The inner and outer hat layers 22A, 22B form a pocket 32 therebetween with a pocket opening 34 located generally opposite the fold 16 and adapted to provide access to the pocket 32. Referring to FIGS. 9-12, an upper hat section 36 is provided that may include bands 38 arranged in a generally checkered pattern 40 to define a plurality of openings 42 through the upper hat section 36. Preferably, but not necessarily, the openings 42 occupy at least twenty (20%) percent of the area covered by the upper hat section 36.

The upper hat section 36 is located on the lower hat section 12. As shown in FIGS. 7 and 8, at least one fastener 44 is preferably located within the pocket 32 on the inner and outer hat layers 22A, 22B to allow the size of the pocket 32 to be adjusted by using the at least one fastener 44 to connect portions of the inner and outer hat layers 22A, 22B. At least one pad 46 is provided and adapted to be inserted in the pocket 32 to cushion a portion of the head of the baby 28. The at least one pad 46 is inserted in the pocket to provide the hat 10 for the baby 28 with an inner surface of the inner hat layer 22A providing a preferably smooth surface that is preferably free of any fasteners, straps, and buckles which may abrade the head of the baby and with the at least one pad 46 protecting at least a portion of the head of the baby 28.

A fourth preferred method of manufacturing a hat 10 according to the present invention is as follows. A lower hat section 12 is provided that preferably includes inner and outer hat layers 22A, 22B. A portion of the inner and outer hat layers 22A, 22B are secured together in a location proximate to an area configured to cover the brow 26 of the baby 28 to prevent the outer hat layer 22B from shifting downwardly and covering portions of a face of the baby 28 not intended to be covered by the hat when the hat is placed thereon. The upper hat section 36 is located on the lower hat section 12. The upper hat section can be of any configuration and formed by any suitable material. At least one fastener 44 is provided to allow the size of the pocket 32 to be adjusted. At least one pad 46 is provided to cushion a portion of the head of the baby. The pad 46 is inserted in the pocket 32 to provide the hat for the baby 28 with an inner surface of the inner hat layer 22A providing a smooth surface that is free of any fasteners, straps, and buckles which may abrade the head of the baby and with the pad protecting at least a portion of the head of the baby.

While various shapes, configurations, and features have been described above and shown in the drawings for the various embodiments of the present invention, those of ordinary skill in the art will appreciate from this disclosure that any combination of the above features can be used without departing from the scope of the present invention. For example, the hat 10 can be formed of woven, unwoven, synthetic, natural, or blended material; the upper hat section 36 may include openings 42 or omit them altogether; the lower hat section 12 can be formed by a single or more layers of material; one or more pads can be fastened or positioned on the hat 10 by placing them in the pocket, fastening them in the pocket; or fastening them to the outside of the hat; and/or the lower and upper hat sections 12, 36 can be integrally formed or formed of multiple components without departing from the scope of the present invention. Furthermore, those of ordinary skill in the art will appreciate from this disclosure that each of the methods of the present invention can include putting any one or more of a fastener, button, buckle or the like on the inner surface of the inner hat layer without departing from the scope of the present invention. The hat 10 of the present invention can be used with children and adults without departing from the scope of the present invention. Accordingly, it is recognized by those skilled in the art that changes may be made to the above described embodiments of the hat without departing from the broad inventive concept thereof. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A method of manufacturing a hat adapted to support and protect a head of a baby when the baby is lying on a generally flat surface, comprising the steps of:

providing a lower hat section formed by woven fabric, the lower hat section comprising a sleeve positioned to form a fold with one portion of the sleeve overlying another portion of the sleeve such that the sleeve forms inner and outer hat layers, the fold defines a hat bottom adapted for placement over the head of the baby with the inner hat layer substantially covering a brow and a back of the head of the baby, the inner and outer hat layers forming a pocket therebetween with a pocket opening located generally opposite the fold and adapted to provide access to the pocket;

providing an upper hat section formed by woven fabric, the upper hat section comprising a plurality of bands arranged in a generally checkered pattern to define a plurality of openings through the upper hat section to facilitate venting of heat and/or moisture therethrough;

locating the upper hat section on the lower hat section;

positioning at least one fastener within the pocket to facilitate securing at least one pad thereto;

providing the least one pad adapted to be inserted in the pocket to cushion a portion of the head of the baby and to facilitate the prevention of deformation of the head of the baby caused by the baby lying on the generally flat surface; and inserting the at least one pad in the pocket to provide the hat for the baby with an inner surface of the inner hat layer providing a generally smooth, flexible woven fabric surface that is free of any fasteners, straps, and buckles which may abrade the head of the baby and with the pad protecting at least a portion of the head of the baby, wherein the hat forms a generally deformable head support adapted to align the head of the baby while the baby is lying on the generally flat surface to facilitate the prevention of deformation of the head of the baby caused by the flat surface.

2. The method of claim 1, further comprising positioning another woven fabric having a different appearance from the sleeve on one surface of the sleeve such that when the sleeve is positioned to form the fold, the hat appears to have a different material on the outer hat layer from that on the inner hat layer when the hat is positioned on the head of the baby.

3. The method of claim 1, wherein the step of positioning the at least one fastener further comprises positioning hook and loop material inside the pocket on the inner and outer hat layers so the size of the pocket can be varied by pressing a portion of the inner and outer hat layers together.

4. The method of claim 1, further comprising positioning at least another fastener on an outer surface of the lower hat section to allow the attachment of at least another pad to the outside thereof.

5. The method of claim 4, further comprising fastening the least another pad to the outside of the lower hat section so that the hat provides cushioning due to the at least one pad in the pocket and provides additional cushioning due to the at least another pad fastened to the lower hat section.

6. The method of claim 1, wherein the inner and outer hat layers are secured together in a location proximate an area configured to cover the brow of the baby to prevent the outer hat layer from shifting downwardly and covering portions of a face of the baby not intended to be covered by the hat when the hat is placed thereon.

7. The method of claim 1, wherein the step of providing the upper hat section further comprises the plurality of openings occupying at least thirty (30%) percent of the area covered by the upper hat section.

8. The method of claim 1, wherein the step of providing the upper hat section further comprises the plurality of openings occupying at least forty (40%) percent of the area covered by the upper hat section.

9. The method of claim 1, further comprising positioning at least another fastener within the pocket on at least one of the inner and outer hat layers to allow the size of the pocket to be adjusted by using the at least one fastener to connect portions of the inner and outer hat layers.

10. A method of manufacturing a hat adapted to support and protect a head of a baby when the baby is lying on a generally flat surface, comprising the steps of:

providing a lower hat section formed by woven fabric, the lower hat section comprising a sleeve configured for placement over the head of the baby to substantially cover a brow and a back of the head of the baby;

providing an upper hat section formed by woven fabric, the upper hat section comprising a plurality of bands arranged in a generally checkered pattern to define a plurality of openings through the upper hat section to facilitate venting of heat and/or moisture therethrough, wherein the plurality of openings occupy at least twenty (20%) percent of the area covered by the upper hat section;

locating the upper hat section on the lower hat section;

positioning at least one fastener on an outer surface of the lower hat section to allow the attachment of at least one pad thereto;

providing at least one pad adapted to cushion a portion of the head of the baby and to facilitate the prevention of deformation of the head of the baby caused by the baby lying on a flat surface; and securing the at least one pad onto the outside of the lower hat section wherein an inner surface of the lower hat section generally provides a smooth, flexible woven fabric surface adapted to contact the head of the baby and with the at least one pad protecting at least a portion of the head of the baby, wherein the hat forms a generally deformable head support adapted to properly align the head of the baby while the baby is lying on the generally flat surface to facilitate prevention of deformation of the head of the baby caused by the generally flat surface.

11. The method of claim 10, wherein the step of providing the upper hat section further comprises the plurality of openings occupying at least thirty (30%) percent of the area covered by the upper hat section.

12. The method of claim 10, wherein the step of providing the upper hat section further comprises the plurality of openings occupying at least forty (40%) percent of the area covered by the upper hat section.

13. The method of claim 10, wherein the step of securing the at least one pad further comprises an inner surface of the lower hat section provides a smooth woven fabric surface that is free of any fasteners, straps, and buckles which may abrade the head of the baby and with the at least one pad protecting at least a portion of the head of the baby.

14. A method of manufacturing a hat adapted to support and protect a head of a baby when the baby is lying on a generally flat surface, comprising the steps of:

providing a lower hat section, the lower hat section comprising a sleeve positioned to form a fold with one portion of the sleeve overlying another portion of the sleeve such that the sleeve forms inner and outer hat layers, the fold defines a hat bottom adapted for placement over the head of the baby with the inner hat layer substantially covering a brow and a back of the head of the baby, the inner and outer hat layers forming a pocket therebetween with a pocket opening located generally opposite the fold and adapted to provide access to the pocket;

providing an upper hat section, the upper hat section comprising a plurality of bands arranged in a generally checkered pattern to define a plurality of openings through the upper hat section to facilitate venting of heat and/or moisture therethrough, wherein the plurality of openings occupy at least twenty (20%) percent of the area covered by the upper hat section;

locating the upper hat section on the lower hat section;

positioning at least one fastener within the pocket to secure at least one pad thereto;

providing the at least one pad adapted to be inserted in the pocket to cushion a portion of the head of the baby and to facilitate the prevention of deformation of the head of the baby caused by the baby lying on a flat surface; and inserting the at least one pad in the pocket to provide the hat for the baby with an inner surface of the inner hat layer providing a generally smooth surface adapted to contact the head of the baby and with the at least one pad protecting at least a portion of the head of the baby, wherein the hat forms a generally deformable head support adapted to properly align the head of the baby while the baby is lying on the generally flat surface to facilitate prevention of deformation of the head of the baby caused by the generally flat surface.

15. The method of claim 14, further comprising positioning another material having a different appearance from the sleeve on one surface of the sleeve such that when the sleeve is positioned to form a fold, the hat appears to have a different material on the outer hat layer from that on the inner hat layer when the hat is positioned on the head of the baby.

16. The method of claim 14, wherein the step of positioning the at least one fastener further comprises positioning hook and loop material inside the pocket on the inner and outer hat layers so the size of the pocket can be varied by pressing a portion of the inner and outer hat layers together.

17. The method of claim 14, further comprising positioning at least one fastener on an outer surface of the lower hat section to allow the attachment of at least another pad to the outside thereof.

18. The method of claim 14, further comprising fastening at least another pad to the outside of the lower hat section so that the hat provides cushioning due to the at least one pad in the pocket and provides additional cushioning due to the at least another pad fastened to the lower hat section.

19. The method of claim 18, wherein the inner and outer hat layers are secured together in an area proximate that configured to cover the brow of the baby to prevent the outer hat layer from shifting downwardly and covering portions of a face of the baby not intended to be covered by the hat when the hat is placed thereon.

20. The method of claim 14 further comprising positioning at least another fastener within the pocket on the inner and outer hat layers to allow the size of the pocket to be adjusted by connecting portions of the inner and outer hat layers.

21. A method of manufacturing a hat adapted to protect and support a head of a baby lying on a generally flat surface, comprising the steps of:

providing a lower hat section, the lower hat section comprising a sleeve positioned to form a fold with one portion of the sleeve overlying another portion of the sleeve such that the sleeve forms inner and outer hat layers, the fold defines a hat bottom adapted for placement over the head of the baby with the inner hat layer substantially covering a brow and a back of the head of the baby, the inner and outer hat layers forming a pocket therebetween with a pocket opening located generally opposite the fold and adapted to provide access to the pocket;

securing a portion of the inner and outer hat layers together in a location proximate to an area configured to cover the brow of the baby to prevent the outer hat layer from shifting downwardly and covering portions of a face of the baby not intended to be covered by the hat when the hat is placed thereon;

locating an upper hat section on the lower hat section;

positioning at least one fastener within the pocket adapted to secure at least one pad thereto;

providing at least one pad adapted to be inserted in the pocket to cushion a portion of the head of the baby and to facilitate the prevention of deformation of the head of the baby caused by the baby lying on a flat surface; and inserting the at least one pad in the pocket to provide the hat for the baby with an inner surface of the inner hat layer providing a smooth surface that is free of any fasteners, straps, and buckles which may abrade the head of the baby and with the pad protecting at least a portion of the head of the baby, wherein the hat forms a generally deformable head support adapted to properly align the head of the baby while the baby is lying on the generally flat surface to facilitate prevention of deformation of the head of the baby caused by the generally flat surface.

22. The method of claim 21, wherein the step of positioning the at least one fastener further comprises positioning hook and loop material inside the pocket on the inner and outer hat layers so the size of the pocket can be varied by pressing a portion of the inner and outer hat layers together.

23. The method of claim 22, further comprising positioning at least one fastener on an outer surface of the lower hat section to allow the attachment of at least another pad to the outside thereof.

24. The method of claim 23, further comprising fastening at least another pad to the outside of the lower hat section so that the hat provides cushioning due to the at least one pad in the pocket and provides additional cushioning due to the at least another pad fastened to the lower hat section.

25. The method of claim 23, further comprising fastening at least another pad to the outside of the lower hat section so that the hat provides cushioning due to the at least one pad in the pocket and provides additional cushioning due to the at least another pad fastened to the lower hat section, the at least another pad being positioned to also prevent rolling of the head of the baby when the baby is positioned on a back thereof.

26. The method of claim 21, wherein the step of inserting the at least one pad further comprises fastening the at least one pad to an inner surface of the pocket.

27. A method of manufacturing a hat that protects a head of a baby, comprising the steps of:

providing a lower hat section formed by woven fabric, the lower hat section comprising a sleeve positioned to form a fold with one portion of the sleeve overlying another portion of the sleeve such that the sleeve forms inner and outer hat layers, the fold defines a hat bottom adapted for placement over the head of the baby with the inner hat layer substantially covering a brow and a back of the head of the baby, the inner and outer hat layers forming a pocket therebetween with a pocket opening located generally opposite the fold and adapted to provide access to the pocket;

providing an upper hat section formed by woven fabric, the upper hat section comprising a plurality of bands arranged in a generally checkered pattern to define a plurality of openings through the upper hat section to facilitate venting of heat and/or moisture therethrough;

locating the upper hat section on the lower hat section;

providing at least one pad adapted to be inserted in the pocket to cushion a portion of the head of the baby and to facilitate the prevention of deformation of the head of the baby caused by the baby lying on a generally flat surface; and inserting the at least one pad in the pocket to protect at least a portion of the head of the baby, wherein the hat forms a generally deformable head support adapted to properly align the head of the baby while the baby is lying on the generally flat surface to facilitate prevention of deformation of the head of the baby caused by the generally flat surface.

28. A hat adapted to support and protect a head of a baby when the baby is lying on a generally flat surface, comprising:

a lower hat section formed by woven fabric, the lower hat section comprising a sleeve positioned to form a fold with one portion of the sleeve overlying another portion of the sleeve such that the sleeve forms inner and outer hat layers, the fold defines a hat bottom adapted for placement over the head of the baby with the inner hat layer substantially covering a brow and a back of the head of the baby, the inner and outer hat layers forming a pocket therebetween with a pocket opening located generally opposite the fold and adapted to provide access to the pocket;

an upper hat section formed by woven fabric, the upper hat section comprising a plurality of bands arranged in a generally checkered pattern to define a plurality of openings through the upper hat section to facilitate venting of heat and/or moisture therethrough, the upper hat section being located on the lower hat section;

at least one fastener located within the pocket to facilitate securing at least on pad thereto;

the least one pad adapted to be inserted in the pocket to cushion a portion of the head of the baby and to facilitate the prevention of deformation of the head of the baby caused by the baby lying on the generally flat surface, wherein the at least one pad is adapted for insertion in the pocket to provide the hat for the baby with an inner surface of the inner hat layer providing a generally smooth, flexible woven fabric surface that is free of any fasteners, straps, and buckles which may abrade the head of the baby and with the pad adapted to protect at least a portion of the head of the baby, wherein the hat forms a generally deformable head support adapted to align the head of the baby while the baby is lying on the generally flat surface to facilitate the prevention of deformation of the head of the baby caused by the flat surface.

* * * * *